United States Patent [19]

Hammelmann

[11] Patent Number: 4,737,084

[45] Date of Patent: Apr. 12, 1988

[54] HIGH-PRESSURE PLUNGER PUMP

[76] Inventor: Paul Hammelmann, Zum Zundern 17, 4740 Oelde 1, Fed. Rep. of Germany

[21] Appl. No.: 922,158

[22] Filed: Oct. 23, 1986

[30] Foreign Application Priority Data

Nov. 25, 1985 [DE] Fed. Rep. of Germany ..... 3541540

[51] Int. Cl.[4] ..... F04B 7/02; F04B 39/08; F04B 23/04; F04B 21/00

[52] U.S. Cl. ..... 417/454; 417/457; 417/507; 417/529; 417/539

[58] Field of Search ..... 417/457, 296, 469, 454, 417/507, 508, 511, 520, 558, 529, 530, 539

[56] References Cited

U.S. PATENT DOCUMENTS 4,407,640 10/1983 Namekata ..... 417/311

FOREIGN PATENT DOCUMENTS 2631217 7/1980 Fed. Rep. of Germany .

*Primary Examiner*—William L. Freeh

*Assistant Examiner*—Leonard P. Walnoha

*Attorney, Agent, or Firm*—Erwin S. Teltscher

[57] ABSTRACT

A high-pressure plunger pump which is designed for maximum pressures in the range between 1,000 and 4,000 bars includes a pump housing centered on an axis and including a main body having two axially spaced ends, and a pump head mounted on one of the ends of the main body. A plunger coaxially extends into the pump housing, and a sleeve is floatingly supported on the plunger. The sleeve has two end portions one of which is closer to the pump head than the other, converges toward the pump head and has an axial end face. Pressure and suction valves are coaxially arranged within the housing. The pump head includes a tube which forms a collecting container for a pressurized medium being pumped. This tube has a bore extending transversely of a longitudinal axis of the tube and around the axis of the housing and receiving a sleeve-shaped end portion of a pressure valve holder, and an external contact surface surrounding one end of the bore and engaging a corresponding sealing surface of the holder.

11 Claims, 4 Drawing Sheets

HIGH-PRESSURE PLUNGER PUMP

BACKGROUND OF THE INVENTION

The present invention relates to pumps in general, and more particularly to a high-pressure plunger pump.

There are already known various constructions of plunger pumps, among them such in which a pressure valve and a suction valve are coaxially arranged in a pump housing which includes a main body and a pump head secured to one end of the main body, wherein a plunger extends into the interior of the pump housing, and a sleeve is floatingly supported on the plunger and has one end portion which is closer to the pump head than the other and converges toward the pump head, and in which the suction valve includes a spring-loaded annular suction valve member which is supported at the region of its outer edge on an annular surface of a part of the pump head and at an axial end face of the sleeve.

A high-pressure plunger pump of this kind is described, for instance, in the German patent application P No. 26 31217. In this construction, the pump head is constructed as a one-piece metal block which is provided with a collecting conduit for the pressurized medium and with at least one recess for the pressure valve or valves. Experience with this construction has shown, however, that when the pump is to be constructed for operation at high working loads of, for instance, 500 kW, the pump head is extremely heavy, so that it cannot be dismounted from the main housing body of the pump without resorting to the use of special equipment, especially lifting and lowering equipment, which may not always be readily available at the location of use of the pump, thus causing extensive delays before the pump can be put back into operation.

SUMMARY OF THE INVENTION

Accordingly, it is a general object of the present invention to avoid the disadvantages of the prior art.

More particularly, it is an object of the present invention to provide a high-pressure plunger pump which does not possess the drawbacks of the known pumps of this type.

Still another object of the present invention is to develop a pump of the above type in which the pump head has a relatively low weight.

It is yet another object of the present invention to design the pump of the type here under consideration in such a manner that the pump head thereof consists of a number of separate parts which can be mounted and dismounted very easily without resorting to the use of any mechanical lifting and lowering equipment even when the pump is constructed for operation at loads in the range of 500 kW or more.

A concomitant object of the present invention is to construct the pump of the above type in such a manner as to be relatively simple in construction, inexpensive to manufacture, easy to use, and yet reliable in operation.

In keeping with these objects and others which will become apparent hereafter, one feature of the present invention resides in a high-pressure plunger pump which comprises a pump housing including a main body centered on a main axis and having two axially spaced ends, and a pump head secured to one of the ends of the main body and including a tube which is centered on a longitudinal axis and bounds a collecting space for a pressurized medium being pumped. The tube has a bore extending transversely of the longitudinal axis and around the main axis and an external contact surface surrounding one end of the bore. A plunger extends into the pump housing coaxially with the main axis and is operative for conducting a pressure stroke and a suction stroke during the operation of the pump. A sleeve is floatingly supported on the plunger. The sleeve surrounds a working space and has two end portions one of which is closer to the pump head than the other, converges toward the pump head and has an axial end face. A pressure valve is coaxially supported in the housing and includes a holder secured to the pump housing and having a portion which extends into the bore of the tube and a sealing surface which sealingly engages the contact surface of the tube, and a pressure valve member accommodated in the holder coaxially with the main axis and interposed in the path of flow of the pressurized medium from the working space through the bore into the tube. A suction valve is coaxially arranged within the housing and includes an annular suction valve member having an outer and an inner edge region which respectively sealingly contact a seating region of the pump head and the axial end face of the sleeve as the piston conducts its pressure stroke, and spring means urging the suction valve member toward the aforementioned contact.

A particularly simple and otherwise advantageous construction of the plunger pump of the present invention is obtained when the pump head further includes a housing lid arranged at the one end of the main body, a plurality of threaded fastening elements connected to the housing lid and extending therefrom away from the main body substantially parallel with the main axis, and at least one yoke mounted on the threaded fastening elements and clamping the tube between itself and the housing lid upon tightening of the threaded fastening elements.

According to an advantageous facet of the present invention, the aforementioned portion of the holder is sleeve-shaped, has an outer circumferential surface which bounds an annular passage in the bore of the tube, and includes at least one through communication bore. In this construction, a holding-down element is advantageously arranged at the sleeve-shaped portion of the holder; and wherein the pressure valve further includes a spring extending between the pressure valve member and the holding-down element. The pressure valve member has a front end portion which advantageously includes a plurality of substantially radial webs provided with inclined surfaces which are acted upon by the pressurized medium. It is advantageous when the contact surface of the tube which engages the sealing surface of the holder is substantially flat.

Advantageously, the pump head includes a housing lid arranged at the one end of the main body and having an axial end surface facing away from the main body and a recess which opens on the axial end surface and the holder has a central portion having a radially outwardly projecting collar which is received in the recess of the housing lid and is axially delimited by a respective first end face which is substantially flush with the axial end surface of the housing lid and constitutes the sealing surface and a second end face which constitutes an abutment surface for the spring means of the suction valve. An anchoring groove is advantageously provided at the second end face of the collar and a sealing ring is accommodated in the anchoring groove and outwardly delimits a surface of the holder which is acted on by the hydraulic fluid during the pressure stroke. Surfaces of this kind will be referred to herein as hydraulically effective surfaces. The plunger also has a hydraulically effective surface and wherein the hydraulically effective surface of the holder, which effects the sealing between the contact and sealing surfaces, is advantageously slightly larger than the hydraulically effective surface of the plunger.

Another advantageous feature of the present invention is to be found in a provision of an annulus of guiding webs which are stationary with respect to the main body of the housing and externally guide the sleeve. According to the present invention, the tube constitutes a pressure compensation container. The pump head has a predetermined length and it is advantageous when the tube extends in each of its axial directions by a half of the predetermined length beyond the pump head.

The high-pressure plunger pump of the present invention can be used for maximum pressures in the range between 1,000 and 4,000 bars. At these working pressures, relatively high forces are encountered at the connecting locations of the various structural elements which are acted upon by the hydraulic medium. The magnitudes of these forces are dependent on the respective hydraulically effective area that is determined by the respective sealing diameter, and on the working pressures acting on such hydraulically effective surfaces. Such forces may rise to such high levels that they can be sustained or handled by even very high quality materials only to a limited maximum loading. In the arrangement according to the present invention, the tube which forms the collecting space for the pressurized medium, the sleeve-shaped portion of the pressure valve holder, the annular suction valve member and the sleeve which is floatingly supported on the plunger can be subjected to self-fretting for the avoidance of fatigue failure cracks under the influence of varying or rising loadings by the pressurized medium during the operation of the pump.

The pressure-loaded annular surfaces at the connection locations can be kept so small that the hydraulic forces resulting therefrom hardly exceed the piston rod forces of the drive.

As a result of the use of a tube for the collecting container for the pressurized medium, the pump head obtains a very low weight, so that the mounting and dismounting of the individual parts and also their inspection can be accomplished in a simple manner.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
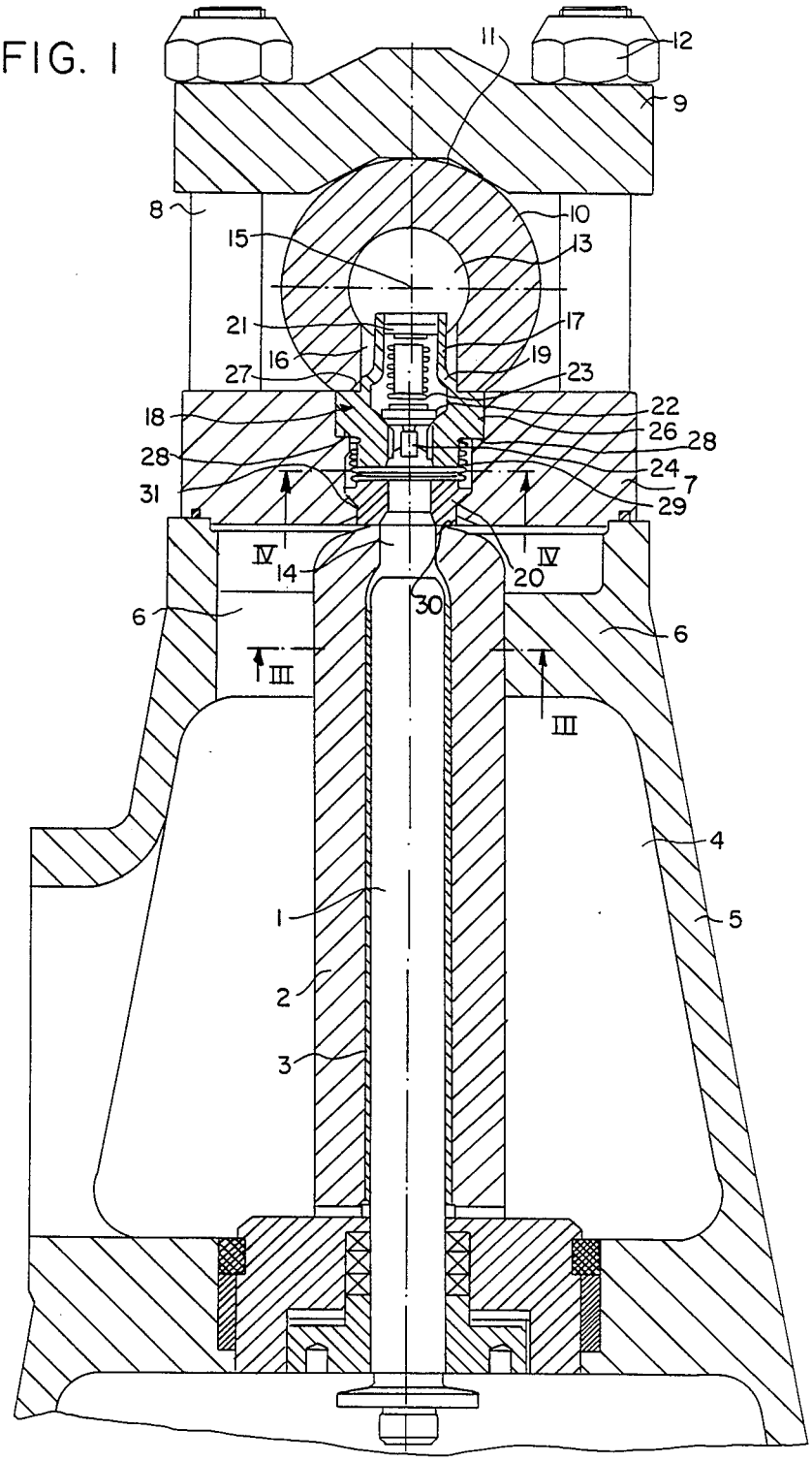
FIG. 1 is a vertical sectional view of a high-pressure plunger pump according to the present invention.
Figure 2:
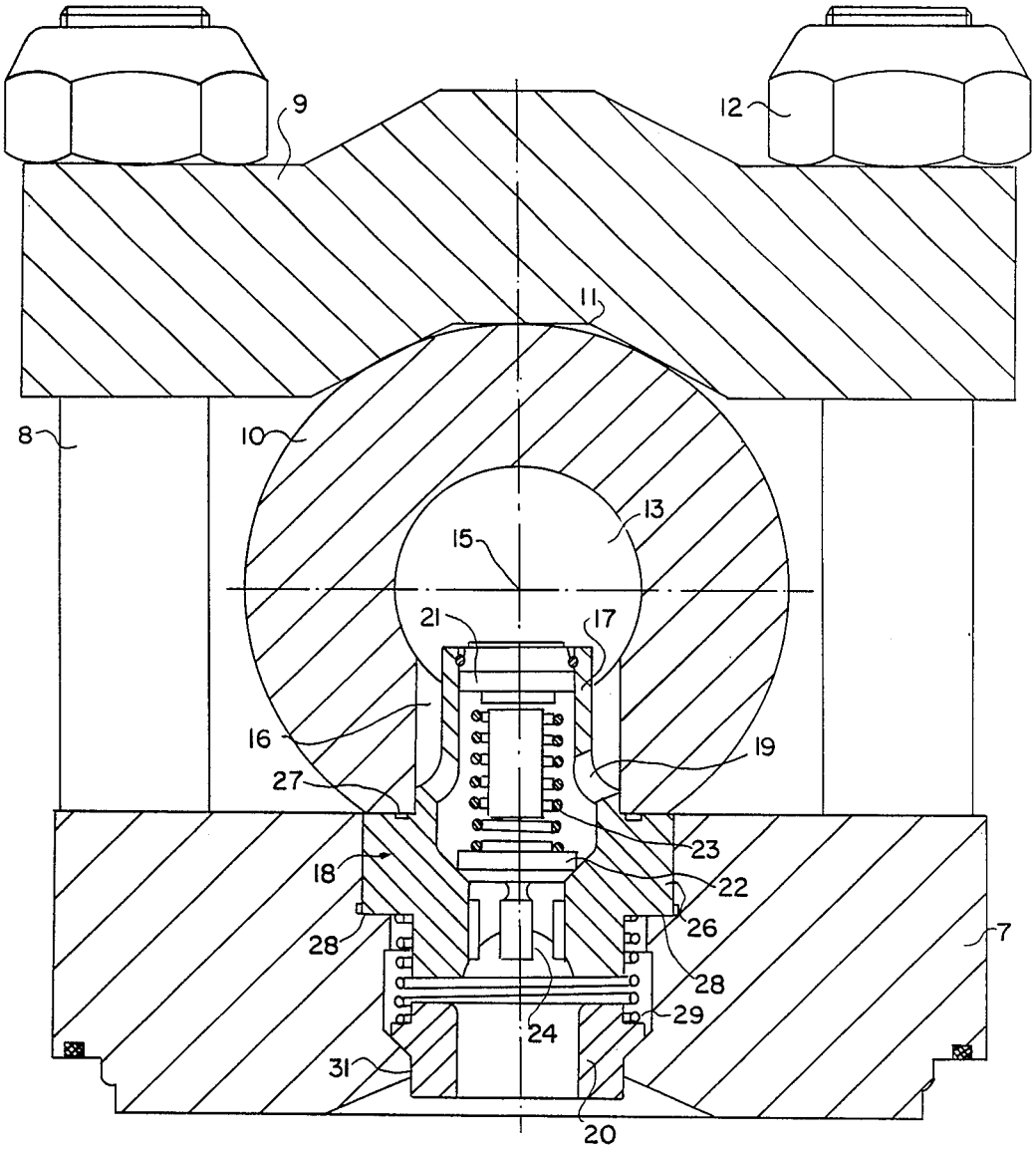
FIG. 2 is a view similar to FIG. 1 but only of an upper part of the pump and at an enlarged scale.
Figure 3:
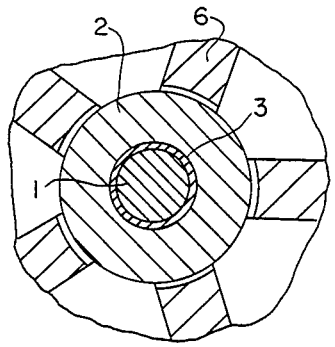
FIG. 3 is a cross-sectional view taken on line III—III of FIG. 1.

Referring now to the drawing in detail, and first to FIG. 1 thereof, it may be seen that the reference numeral 1 has been used therein to identify a plunger of a high-pressure plunger pump of the present invention. A sleeve 2 is floatingly supported on the plunger 1 with a small axial play. A sliding layer or film 3 of the medium being pumped is formed between the plunger 1 and the sleeve 2. The sleeve 2 is arranged in a suction space 4 of the pump which is outwardly bounded by a housing 5. Webs 6 are arranged in the housing 5. As shown in FIG. 3, the webs 6 form a ring in which the sleeve 2 is outwardly guided. The webs 6 are stationarily positioned in the housing 5.

The housing 5 has an upper opening which is closed by a housing lid 7. The housing lid 7 is equipped with upright bolts 8 which have threaded portions that extend through bores of one or more yoke parts 9. A tube 10 is clamped between the yoke part 9 and the housing lid 7. A part of the tube 10 is received in a recess 11 of the yoke part 9. The clamping or pretensioning and the positional securing of the tube 10 is achieved by means of nuts 12 which are threaded onto the upright bolts 8. A collecting space 13 for a pressurized medium which is being pumped by the plunger 1 from a working space 14 of the pump is arranged in the tube 10. The supply of the pressurized medium into the collecting space 13 takes place through a bore 16 which extends transversely with respect to a longitudinal axis 15 of the tube 10. An end portion 17 of a pressure valve holder 18 extends into the bore 16. The end portion 17 has a sleeve-shaped configuration and defines an annular flow channel with an internal surface of the tube 10. The sleeve-shaped end portion 17 is further provided with flow-through bores 19.

Figure 4:
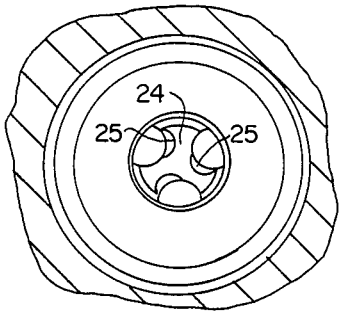
FIG. 4 is a cross-sectional view taken on line IV—IV of FIG. 1 and at an enlarged scale and FIG. 5 is a large-scale fragmentary side view of the top portion of the pump.
Figure 5:
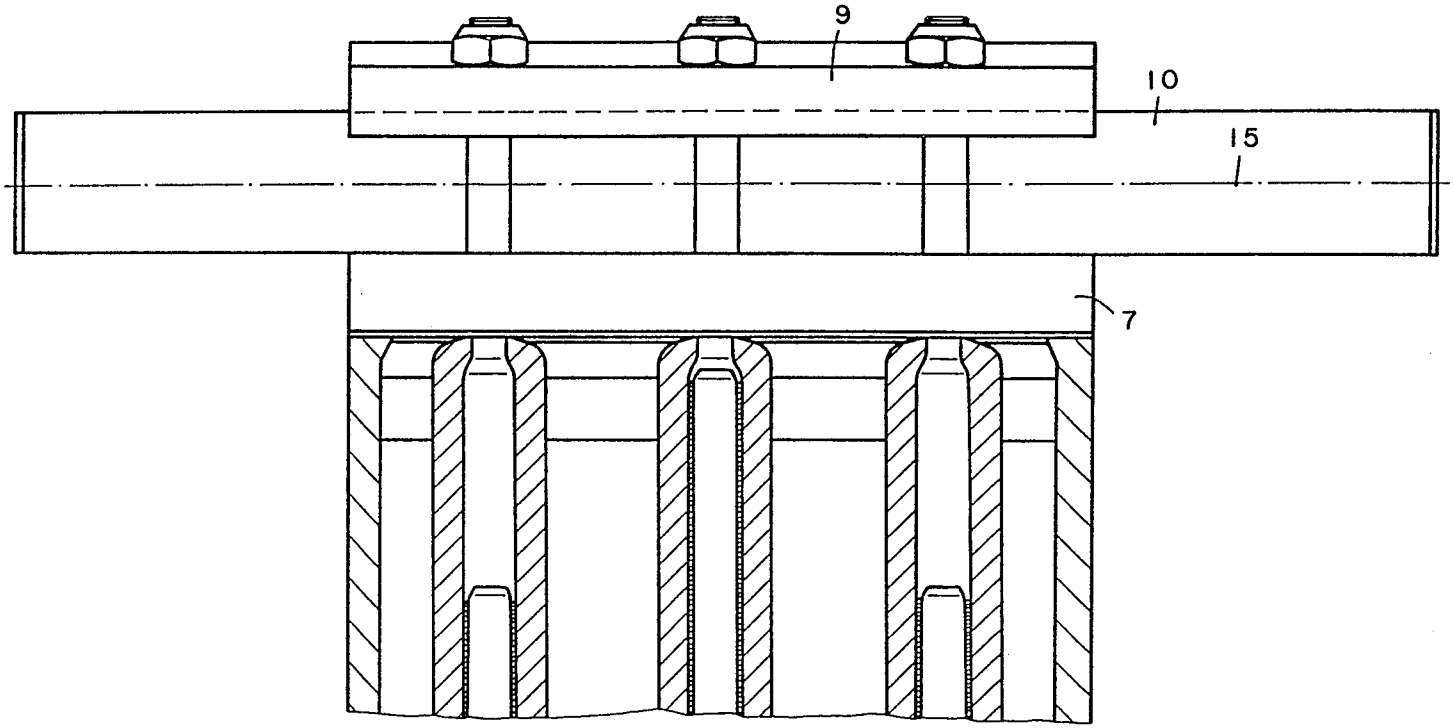

The pressure valve holder 18, together with an annular suction valve body 20, is mounted in a recess of the housing lid 7. A holding-down element 21 is secured at the end of the sleeve-shaped end portion 17. A spring 23 which is associated with a pressure valve body 22 braces itself against the holding-down element 21. The pressure valve body 22 is provided at its forward end with guiding webs 24. As may be ascertained from FIG. 4, the guiding webs 24 form an annulus or ring. The guiding webs 24 are provided with inclined control surfaces 25 (see particularly FIG. 4) which are acted upon by the pressurized medium. Due to the presence of these control surfaces 25, the pressure valve body 22 is forced to conduct a rotary motion during its pressure stroke, owing to the flow of the pressurized medium through the valve. As a result of this rotary motion, there is obtained self-polishing of the two sealing surfaces of the pressure valve, so that a seating surface of the pressure valve holder 18 is capable of sustaining the high surface pressure exerted thereon by the pressure valve body 22.

The pressure valve holder 18 is provided at its central region with a collar 26. The collar 26 is upwardly delimited by an upper delimiting surface which is flush with an upper delimiting surface of the housing lid 7 and forms a sealing surface with respect to the tube 10. The tube 10 is flattened at an edge region of the bore 16 and abuts the sealing surface of the pressure valve holder 18. An anchoring groove which accommodates a sealing ring 27 is provided at the region of the sealing surface of the pressure valve holder 18. A spring 29, which is associated with the suction valve body 20, braces itself against a lower delimiting surface of the collar 26.

An anchoring groove for a sealing ring 28 is provided at a region of the lower delimiting surface of the collar 26. This sealing ring 28 delimits in the outward direction a surface of the pressure valve holder 18 which is hydraulically effective during the pressure stroke and which determines the pressure force between the pressure valve holder 18 and the tube 10.

When the area of the end face of the plunger 1 is multiplied by the working pressure, there is obtained an effective piston rod force. The sealing forces which are achieved at the sealing region between the pressure valve holder 18 and the tube 10 are slightly higher than this effective piston rod force.

During the suction stroke, while the plunger 1 is being retracted, the suction valve body 20 moves towards and into its open position, so that the medium to be pumped is capable of flowing from the suction space 4 into the working space 14 of the pump which is constituted by the internal space of the sleeve 2.

The sleeve 2 has an upper mouth portion 30 which abuts the suction valve body 20 during the suction stroke. A pressure-resistant sealing effect between the above-mentioned parts comes into being owing to the resulting hydraulic forces at the sleeve mouth portion 30, as well as the hydraulic counterforce with which the suction valve body 20 is pressed against its sealing surface 31.

The provision of the webs 6 for the external guidance of the sleeve 2 is particularly advantageous when the high-pressure plunger pump of the present invention is to be installed on off-the-road vehicles, as well as for the use of the pump in underground mining and on ships, since the longitudinal axis of the pump frequently deviates from the vertical direction in such circumstances, so that the gravity force as well as acceleration forces act on the sleeve 2 and adversely affect the film 3 which is formed by the medium being pumped in the sealing gap between the plunger 1 and the sleeve 2 and which separates the plunger 1 and the sleeve 2 from one another. In such applications, it is recommended to provide the guiding webs 6. The guiding webs 6 also perform an additional useful function of streamlining the flow of the medium toward the suction valve.

When choosing the length of the tube 10, which is simultaneously to serve as a pressure compensation container, various parameters are to be taken into consideration. Such parameters are dependent on the flow-through amount of the medium, the number of pistons, the pressure and the speed of rotation of the crank shaft. As a coarse rule of thumb, the choice may be made in such a manner that the tube 10 projects in each of the rightward and in the leftward directions by one-half of the width of the pumphead, sometimes also referred to as the length of the pump head, so that there is obtained altogether a doubling of the width (or length) of the pumphead as seen in an axial direction. In this connection, it is to be mentioned that even that part of the tube 10 which purely optically appears to constitute a part of the pump head also jointly performs the function of the compensator due to its tubular form.

While the present invention has been described and illustrated herein as embodied in a specific construction of a high-pressure plunger pump, it is not limited to the details of this particular construction, since various modifications and structural changes are possible and contemplated by the present invention. Thus, the scope of the present invention will be determined exclusively by the appended claims.

What is claimed is:

1. A high-pressure plunger pump, comprising a pump housing including a main body centered on a main axis and having two axially spaced ends, and a pump head secured to one of said ends of said main body and including a tube which is centered on a longitudinal axis and bounds a collecting space for a pressurized medium being pumped, said tube having a bore and extending transversely of said longitudinal axis and around said main axis, and an external contact surface surrounding one end of said bore;

a plurality of plungers extending into said pump housing at least parallel with said main axis and operative for conducting a pressure stroke and a suction stroke during the operation of the pump;

each plunger having a sleeve floatingly supported on said plunger, surrounding a working space and having two end portions one of which is closer to said pump head than the other, converges toward said pump head and has an axial end face;

a pressure valve including a holder secured to said pump housing and having a portion which extends into said bore of said tube and a sealing surface which sealingly engages said contact surface of said tube, a pressure valve member accommodated in said holder coaxially with said main axis and interposed in the path of flow of the pressurized medium from the working space through said bore into said tube; and a suction valve coaxially arranged within said housing and including an annular suction valve member having an outer and an inner edge region which respectively sealingly contact a seating region of said pump head and said axial end face of said sleeve as said plunger conducts said pressure stroke thereof, and spring means urging said suction valve member toward said contact, and wherein said pump head further includes a housing lid arranged at said one end of said main body, a plurality of threaded fastening elements connected to said housing lid and extending therefrom away from said main body substantially parallel with said main axis, and at least one yoke mounted on said threaded fastening elements and clamping said tube between itself and said housing lid upon tightening of said threaded fastening elements.

2. The plunger pump as defined in claim 1, wherein said portion of said holder is sleeve-shaped, has an outer circumferential surface which bounds an annular passage in said bore of said tube, and includes at least one through communication bore.

3. The plunger pump as defined in claim 2, further comprising a holding-down element arranged at said sleeve-shaped portion of said holder; and wherein said pressure valve further includes a spring extending between said pressure valve member and said holding-down element.

4. The plunger pump as defined in claim 3, wherein said pressure valve member has a front end portion including a plurality of substantially radial webs provided with inclined surfaces which are acted upon by the pressurized medium.

5. The plunger pump as defined in claim 1, wherein said contact surface of said tube which engages said sealing surface of said holder is substantially flat.

6. The plunger pump as defined in claim 5, wherein said pump head further includes a housing lid arranged at said one end of said main body and having an axial end surface facing away from said main body and a recess which opens on said axial end surface; and wherein said holder has a central portion having a radially outwardly projecting collar which is received in said recess of said housing lid and is axially delimited by a respective first end face which is substantially flush with said axial end surface of said housing lid and constitutes said sealing surface, and a second end face which constitutes an abutment surface for said spring means of said suction valve.

7. The plunger pump as defined in claim 6, and further comprising an anchoring groove provided at said second end face of said collar, and a sealing ring accommodated in said anchoring groove and outwardly delimiting a hydraulically effective surface of said holder during said pressure stroke.

8. The plunger pump as defined in claim 7, wherein said plunger has a hydraulically effective surface; and wherein said hydraulically effective surface of said holder, which effects the sealing between said contact and sealing surfaces, is slightly larger than said hydraulically effective surface of said plunger.

9. The plunger pump as defined in claim 7, and further comprising an annulus of guiding webs which are stationary with respect to said main body of said housing and externally guide said sleeve.

10. The plunger pump as defined in claim 1, wherein said tube constitutes a pressure compensation container.

11. A high-pressure plunger pump, comprising a pump housing including a main body centered on a main axis and having two axially spaced ends, and a pump head secured to one of said ends of said main body and including a tube which is centered on a longitudinal axis and bounds a collecting space for a pressurized medium being pumped, said tube having a bore and extending transversely of said longitudinal axis and around said main axis, and an external contact surface surrounding one end of said bore;

a plurality of plungers extending into said pump housing at least parallel with said main axis and operative for conducting a pressure stroke and a suction stroke during the operation of the pump;

each plunger having a sleeve floatingly supported on said plunger, surrounding a working space and having two end portions one of which is closer to said pump head than the other, converges toward said pump head and has an axial end face;

a pressure valve including a holder secured to said pump housing and having a portion which extends into said bore of said tube and a sealing surface which sealingly engages said contact surface of said tube, a pressure valve member accomodated in said holder coaxially with said main axis and interposed in the path of flow of the pressurized medium from the working space through said bore into said tube; and a suction valve coaxially arranged within said housing and including an annular suction valve member having an outer and an inner edge region which respectively sealingly contact a seating region of said pump head and said axial end face of said sleeve as said plunger conducts said pressure stroke thereof, and spring means urging said suction valve member toward said contact, wherein said contact surface of said tube which engages said sealing surface of said holder is substantially flat, wherein said pump head further includes a housing lid arranged at said one end of said main body and having an axial end surface facing away from said main body and a recess which opens on said axial end surfaces; and wherein said holder has a central portion having a radially outwardly projecting collar which is received in said recess of said housing lid and is axially delimited by a respective first end face which is substantially flush with said axial end surface of said housing lid and constitutes said sealing surface, and a second end face which constitutes an abutment surface for said spring means of said suction valve, an anchoring groove being provided at said second end face of said collar, and a sealing ring accommodated in said anchoring groove and outwardly delimiting a hydraulically effective surface of said holder during said pressure stroke, and an annulus of guiding webs which are stationary with respect to said main body of said housing and externally guide said sleeve.

* * * * *